US011127345B1

(12) United States Patent
Seo et al.

(10) Patent No.: US 11,127,345 B1
(45) Date of Patent: Sep. 21, 2021

(54) DISPLAY DEVICE AND DRIVING METHOD THEREOF

(71) Applicant: SAMSUNG DISPLAY CO., LTD., Yongin-si (KR)

(72) Inventors: Won Jin Seo, Yongin-si (KR); Eun Jin Choi, Yongin-si (KR); Ki Hyun Pyun, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/061,154

(22) Filed: Oct. 1, 2020

(30) Foreign Application Priority Data

Mar. 17, 2020 (KR) ..... 10-2020-0032742

(51) Int. Cl.
*G09G 3/32* (2016.01)
*G09G 3/20* (2006.01)

(52) U.S. Cl.
CPC ..... *G09G 3/32* (2013.01); *G09G 3/2003* (2013.01); *G09G 2310/027* (2013.01); *G09G 2320/0233* (2013.01); *G09G 2320/0285* (2013.01); *G09G 2320/0295* (2013.01); *G09G 2340/16* (2013.01); *G09G 2360/16* (2013.01)

(58) Field of Classification Search
CPC ..... G09G 3/3275; G09G 2310/027; G09G 2320/0233; G09G 3/32; G09G 3/2003; G09G 2320/0285; G09G 2340/16; G09G 2360/16; G09G 2320/0295
See application file for complete search history.

(56) References Cited

U.S. PATENT DOCUMENTS

| | | | | |
|---|---|---|---|---|
| 8,600,049 | B2 | 12/2013 | Gueron et al. | |
| 9,916,790 | B2 | 3/2018 | Kim | |
| 10,303,286 | B2 | 5/2019 | Son et al. | |
| 2012/0038684 | A1* | 2/2012 | Ryu | G09G 3/20 345/690 |
| 2014/0152643 | A1* | 6/2014 | Kim | G09G 3/3258 345/212 |

(Continued)

FOREIGN PATENT DOCUMENTS

| | | | |
|---|---|---|---|
| KR | 10-2016-0024067 | A | 3/2016 |
| KR | 10-1960762 | B1 | 7/2019 |
| KR | 10-2021-0007068 | | 1/2021 |

*Primary Examiner* — Antonio Xavier
(74) *Attorney, Agent, or Firm* — Lewis Roca Rothgerber Christie LLP

(57) ABSTRACT

A display device includes a display divided into a plurality of blocks including pixels, a timing controller for calculating a frame load for an image frame of input image data, and for generating image data by scaling grayscale values of the input image data using a scale factor, a data driver for generating a data signal corresponding to the image data, and for supplying the data signal to the pixels, a current sensor for sensing a global current flowing in a first power source line connected to the pixels, and a scale factor provider for correcting a unit target current determined using a reference block among the blocks based on a deviation in light emitting characteristics between the blocks, for calculating a target current using the frame load and a corrected unit target current, and for comparing the target current with the global current to calculate the scale factor.

20 Claims, 13 Drawing Sheets

(56) References Cited

U.S. PATENT DOCUMENTS

| | | | | |
|---|---|---|---|---|
| 2014/0354698 | A1* | 12/2014 | Lee | G09G 3/3258 345/690 |
| 2015/0255019 | A1* | 9/2015 | Park | G09G 3/3225 345/208 |
| 2015/0310808 | A1* | 10/2015 | Lee | G09G 3/20 345/690 |
| 2016/0125811 | A1* | 5/2016 | Park | G09G 3/3258 345/694 |
| 2017/0148385 | A1* | 5/2017 | Kishi | G09G 3/3283 |
| 2018/0033374 | A1* | 2/2018 | Jeong | G09G 3/3618 |
| 2020/0357344 | A1* | 11/2020 | Pyun | G09G 3/3233 |
| 2021/0012704 | A1 | 1/2021 | Pyun et al. | |

* cited by examiner

FIG. 8

RGB LUT[k]

| index | R-LUT[k] | G-LUT[k] | B-LUT[k] |
|---|---|---|---|
| 1 | 0 | 0 | 0 |
| 2 | 0.000092626 | 0.000091283 | 0.000092626 |
| 3 | 0.004182802 | 0.004148582 | 0.004182487 |
| ⋮ | | | |
| 61 | 175.5688964 | 174.1118964 | 175.3585824 |
| 62 | 177.1052912 | 175.4873754 | 176.1455912 |
| 63 | 178.6489905 | 178.6580355 | 178.6583852 |
| 64 | 180.2000001 | 180.2154235 | 180.2235552 |

DISPLAY DEVICE AND DRIVING METHOD THEREOF

CROSS-REFERENCE TO RELATED APPLICATION

The application claims priority to and the benefit of Korean Patent Application No. 10-2020-0032742, filed Mar. 17, 2020, which is hereby incorporated by reference for all purposes as if fully set forth herein.

BACKGROUND

1. Field

Some embodiments of the present disclosure relate to a display device, and to a driving method thereof.

2. Discussion

With the development of information technology, the importance of display devices, which are a connection medium between users and information, has been emphasized. In response to this, the use of display devices, such as a liquid crystal display device, an organic light emitting display device, and a plasma display device, has been increasing.

A display device includes a plurality of pixels. Image frames displayed by the pixels may have different load values. For example, very bright image frames may have a relatively large load value, and very dark image frames may have a relatively small load value. The larger the load value, the greater the amount of current required by the pixels. For example, when the current supplied to the pixels is insufficient, luminance of an image frame displayed by the pixels may be lower than a target luminance. The smaller the load value, the smaller the amount of current required by the pixels. For example, when the current supplied to the pixels is excessive, the luminance of the image frame displayed by the pixels may be higher than the target luminance.

SUMMARY

Some embodiments of the present disclosure provide a display device capable of appropriately controlling an amount of current suitable for pixels, with respect to a target current, by setting the target current in consideration of a deviation in luminous efficiency for each position in a display area.

Some embodiments of the present disclosure also provide a driving method of the display device.

However, the embodiments of the present disclosure are not limited to the above-described embodiments, and may be varied without departing from the spirit and scope of the present disclosure.

Some embodiments of the present disclosure provide a display device including a display divided into a plurality of blocks including pixels, a timing controller for calculating a frame load for an image frame of input image data, and for generating image data by scaling grayscale values of the input image data using a scale factor, a data driver for generating a data signal corresponding to the image data, and for supplying the data signal to the pixels, a current sensor for sensing a global current flowing in a first power source line connected to the pixels, and a scale factor provider for correcting a unit target current determined using a reference block among the blocks based on a deviation in light emitting characteristics between the blocks, for calculating a target current using the frame load and a corrected unit target current, and for comparing the target current with the global current to calculate the scale factor.

The scale factor provider may include a unit target current determiner for determining the unit target current using the reference block, a memory for storing a plurality of RGB lookup tables that individually define a luminance level according to the grayscale values for each of the blocks, and a unit target current corrector for correcting the unit target current by a reference ratio determined by referring to the RGB lookup tables to generate the corrected unit target current.

The scale factor provider may further include a luminance ratio calculator for comparing a reference lookup table defined for the reference block among the plurality of RGB lookup tables with the RGB lookup tables to calculate a luminance level ratio for each of the blocks.

The luminance level ratio may be a ratio between a luminance level defined in the reference lookup table and a luminance level respectively defined in the RGB lookup tables.

The scale factor provider may further include a reference ratio calculator for calculating the reference ratio using the luminance level ratio calculated for each of the blocks.

The reference ratio may include an intermediate value or an average value of the luminance level ratio calculated for the blocks.

The luminance level ratio may include a first luminance level ratio calculated for a red grayscale value, a second luminance level ratio calculated for a green grayscale value, and a third luminance level ratio calculated for a blue grayscale value.

The reference ratio may include a first reference ratio calculated using the first luminance level ratio, a second reference ratio calculated using the second luminance level ratio, and a third reference ratio calculated using the third luminance level ratio.

The reference ratio calculator may determine an RGB average ratio calculated by averaging the first reference ratio, the second reference ratio, and the third reference ratio as the reference ratio.

The unit target current corrector may be configured to multiply the first reference ratio and the unit target current to generate a corrected first unit target current, to multiply the second reference ratio and the unit target current to generate a corrected second unit target current, and to multiply the third reference ratio and the unit target current to generate a corrected third unit target current.

The scale factor provider may be configured to calculate a first target current by multiplying the corrected first unit target current and the frame load, and to compare a calculated first target current with the global current to calculate a first scale factor, wherein the timing controller is configured to scale red grayscale values of the input image data using the first scale factor.

The reference block may be located in a center of the display.

Other embodiments of the present disclosure provide a driving method of a display device, the method including correcting a unit target current determined using a reference block among a plurality of blocks including pixels based on a deviation in light emitting characteristics between the blocks, calculating a target current using a frame load calculated for an image frame of input image data and a corrected unit target current, calculating a scale factor by comparing the target current with a global current sensed in a first power source line connected to the pixels, generating image data by scaling grayscale values of the input image data using the scale factor, generating a data signal corresponding to the image data, and supplying the data signal to the pixels.

Correcting the unit target current may include correcting the unit target current by a reference ratio determined by referring to a plurality of RGB lookup tables that define a luminance level according to the grayscale values for each of the blocks.

Correcting the unit target current may include comparing a reference lookup table defined for the reference block among the RGB lookup tables with the RGB lookup tables to calculate a luminance level ratio representing the deviation in light emitting characteristics for each of the blocks.

The luminance level ratio may include a ratio between a luminance level defined in the reference lookup table and a luminance level respectively defined in the RGB lookup tables.

Correcting the unit target current may include calculating the reference ratio using the luminance level ratio calculated for each of the blocks.

The reference ratio may include an intermediate value or an average value of the luminance level ratio calculated for each of the blocks.

The luminance level ratio may include a first luminance level ratio calculated for a red grayscale value, a second luminance level ratio calculated for a green grayscale value, and a third luminance level ratio calculated for a blue grayscale value.

The reference ratio may include a first reference ratio calculated using the first luminance level ratio, a second reference ratio calculated using the second luminance level ratio, and a third reference ratio calculated using the third luminance level ratio.

BRIEF DESCRIPTION OF THE DRAWINGS

The accompanying drawings, which are included to provide a further understanding of the inventive concepts, and are incorporated in and constitute a part of this specification, illustrate embodiments of the inventive concepts, and, together with the description, serve to explain aspects of the inventive concepts.

FIG. 8 is an example view illustrating an RGB lookup table according to some embodiments of the present disclosure.

DETAILED DESCRIPTION

Figure 1:
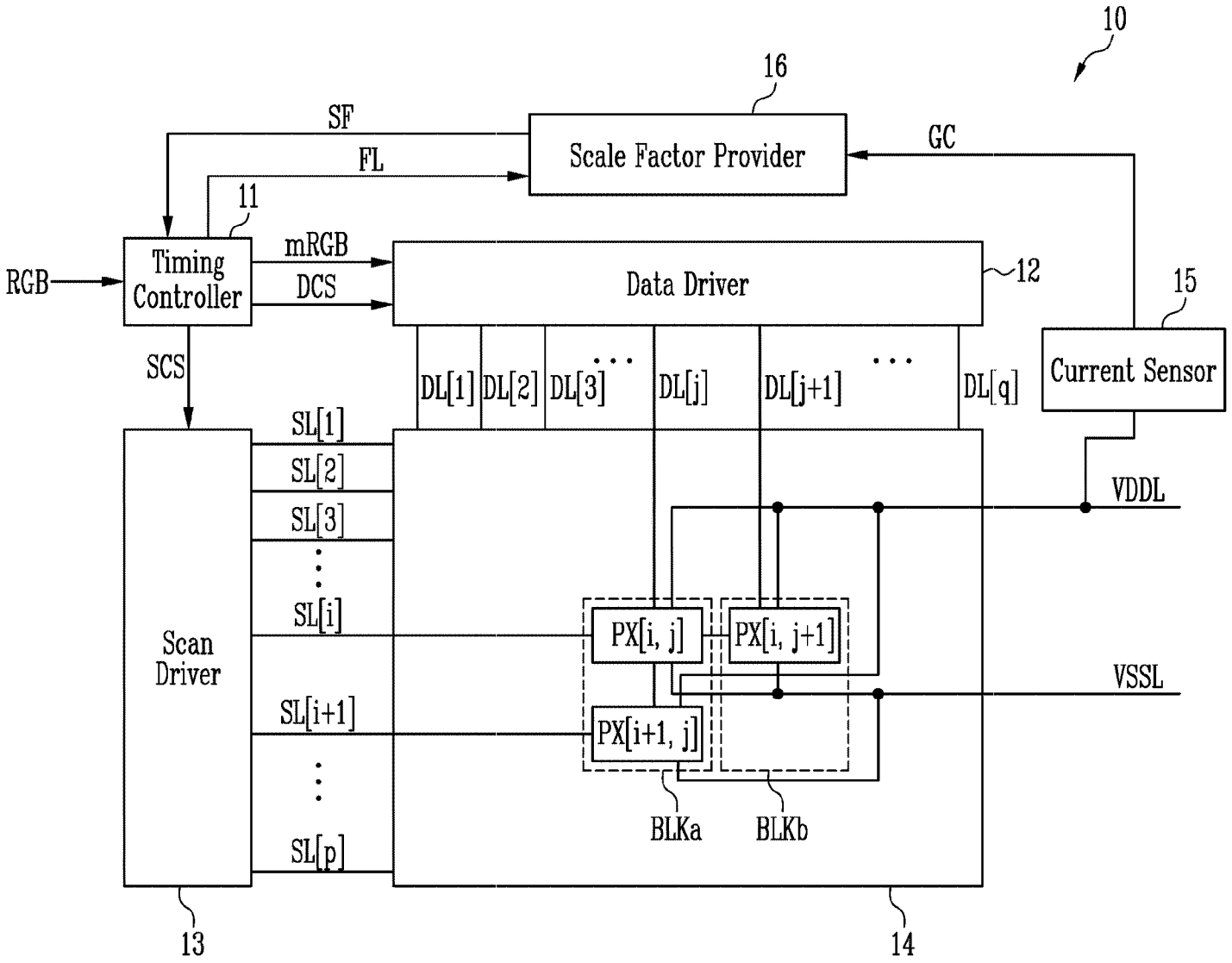
FIG. 1 is a block diagram for explaining a display device according to some embodiments of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described.

Unless otherwise noted, like reference numerals, characters, or combinations thereof denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element, layer, region, or component is referred to as being "formed on," "on," "connected to," or "coupled to" another element, layer, region, or component, it can be directly formed on, on, connected to, or coupled to the other element, layer, region, or component, or indirectly formed on, on, connected to, or coupled to the other element, layer, region, or component such that one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

For the purposes of this disclosure, expressions such as "at least one of," when preceding a list of elements, modify the entire list of elements and do not modify the individual elements of the list. For example, "at least one of X, Y, and Z," "at least one of X, Y, or Z," and "at least one selected from the group consisting of X, Y, and Z" may be construed as X only, Y only, Z only, any combination of two or more of X, Y, and Z, such as, for instance, XYZ, XYY, YZ, and ZZ, or any variation thereof. Similarly, the expression such as "at least one of A and B" may include A, B, or A and B. As used herein, the term "and/or" includes any and all combinations of one or more of the associated listed items. For example, the expression such as "A and/or B" may include A, B, or A and B.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When one or more embodiments may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate.

Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram for explaining a display device according to some embodiments of the present disclosure.

Referring to FIG. 1, a display device 10 may include a timing controller 11, a data driver 12, a scan driver 13, a display 14, a current sensor 15, and a scale factor provider 16.

The timing controller 11 may generate a scan driving control signal SCS and a data driving control signal DCS in response to synchronization signals supplied from outside. The scan driving control signal SCS may be supplied to the scan driver 13, and the data driving control signal DCS may be supplied to the data driver 12.

The scan driving control signal SCS may include a scan start signal and clock signals. The scan start signal may be a signal for controlling a first timing of a scan signal. The clock signals may be used to shift the scan start signal. The data driving control signal DCS may include source start pulse and clock signals. The source start pulse may control a starting point of sampling of data. The clock signals may be used to control the sampling operation.

The timing controller 11 may receive externally supplied input image data RGB. The input image data RGB may include at least one image frame. In some embodiments, the at least one image frame may indicate a red grayscale value R, a green grayscale value G, and/or a blue grayscale value B for each unit dot (each unit dot may correspond to one pixel). However, it should be noted that, when the display 14 has a pentile structure, because adjacent unit dots share a portion of pixels (for example, a portion of sub-pixels included in a pixel), each unit dot may not correspond to one pixel in other embodiments.

The timing controller 11 may calculate a frame load FL for each image frame of the input image data RGB, and may provide the frame load FL to the scale factor provider 16. In addition, the timing controller 11 may scale grayscale values of the input image data RGB using a scale factor SF received from the scale factor provider 16, and may supply image data mRGB, which may be generated using the scaled grayscale values, to the data driver 12. Here, the frame load FL may be a value indicating a load when the display device 10 displays an image frame. For example, the frame load for the image frame (for example, a full white image frame) when all pixels of the display device 10 emit light at a maximum luminance may be 100, and the frame load for the image frame when all pixels do not emit light may be 0. That is, the frame load FL may have a (%) unit value between 0 and 100. In other words, when all of the grayscale values of a first image frame are a maximum grayscale value (for example, 255 based on 8 bits), the frame load of the first image frame may be 100. Also, when all of the grayscale values of a second image frame are a minimum grayscale value (for example, 0), the frame load of the second image frame may be 0.

The data driver 12 may receive the data driving control signal DCS and the image data mRGB from the timing controller 11. The data driver 12 may supply data signals (for example, data voltages) corresponding to the image data mRGB to data lines DL[1], DL[2], DL[3], . . . , DL[j], DL[j+1], . . . , and DL[q]. For example, the data driver 12 may supply the data signals to pixels PX[i, j] arranged on a horizontal line selected by the scan signal. To this end, the data driver 12 may supply the data signals to be synchronized with the scan signal.

The timing controller 11 may scale the input image data RGB according to the scale factor SF to generate the image data mRGB, and the data driver 12 may supply a data signal (or voltage) corresponding to the image data mRGB to each of the pixels included in the display 14 to control a driving current of each of the pixels. This process may be referred to as global current management (GCM).

The scan driver 13 may receive the scan driving control signal SCS from the timing controller 11, and may sequentially supply scan signals to scan lines SL[1], SL[2], SL[3], . . . , SL[i], SL[i+1], . . . , and SL[p] based on the scan driving control signal SCS. When the scan signals are sequentially supplied, the pixels PX[i, j] may be selected in units of horizontal lines (or units of pixel rows), and the data signal may be supplied to the selected pixels PX[i, j].

The display 14 may include a plurality of pixels PX [i, j], PX [i, j+1], and PX [i+1, j]. The plurality of pixels PX[i, j], PX[i, j+1], and PX[i+1, j] may be composed of p rows and q columns, where p and q are natural numbers. The pixels PX[i, j] located in the same row (hereinafter, may be referred to as a horizontal line) may be connected to the same scan line and the same emission line. In addition, the pixels PX[i, j] located in the same column (hereinafter, may be referred to as a vertical line) may be connected to the same data line. For example, a pixel PX [i, j] located in an i-th row and a j-th column may be connected to an i-th scan line SL[i] and a j-th data line DL[j], where i is a natural number less than or equal to p, and j is a natural number less than or equal to q.

The pixels PX[i, j], PX[i, j+1], and PX[i+1, j] may be connected to a first power source line VDDL to which a first power source voltage is supplied and a second power source line VSSL to which a second power source voltage is supplied. The first power source voltage and the second power source voltage may generate voltages for driving a light emitting element included in each pixel PX[i, j] of the display 14. In some embodiments, the second power source voltage may be lower than the first power source voltage. For example, the first power source voltage may be a positive voltage and the second power source voltage may be a negative voltage. The first power source line VDDL and/or the second power source line VSSL may be commonly connected to some or all of the pixels.

The display 14 may be located in a display area of a display panel, and at least one of the timing controller 11, the data driver 12, the scan driver 13, the current sensor 15, and the scale factor provider 16 may be located in a non-display area of the display panel.

The current sensor 15 may sense a global current GC flowing in at least one of the first power source line VDDL and the second power source line VSSL, and may provide the global current GC to the scale factor provider 16. In more detail, the current sensor 15 may sense the global current GC flowing in the first power source line VDDL, and may provide the global current (e.g., information indicating a size of the global current) GC to the scale factor provider 16. When the first power source line VDDL is commonly connected to all of the pixels, the global current GC sensed by the current sensor 15 may be a current commonly supplied to all of the pixels through the first power source line VDDL.

The scale factor provider 16 may calculate a target current using the frame load FL provided from the timing controller 11, and a unit target current UTC, may generate the scale factor SF by comparing the calculated target current with the global current GC received from the current sensor 15, and may provide the generated scale factor SF to the timing controller 11. All or part of the scale factor provider 16 may be implemented with an integrated circuit (IC) chip coupled to the timing controller 11.

Figure 2:
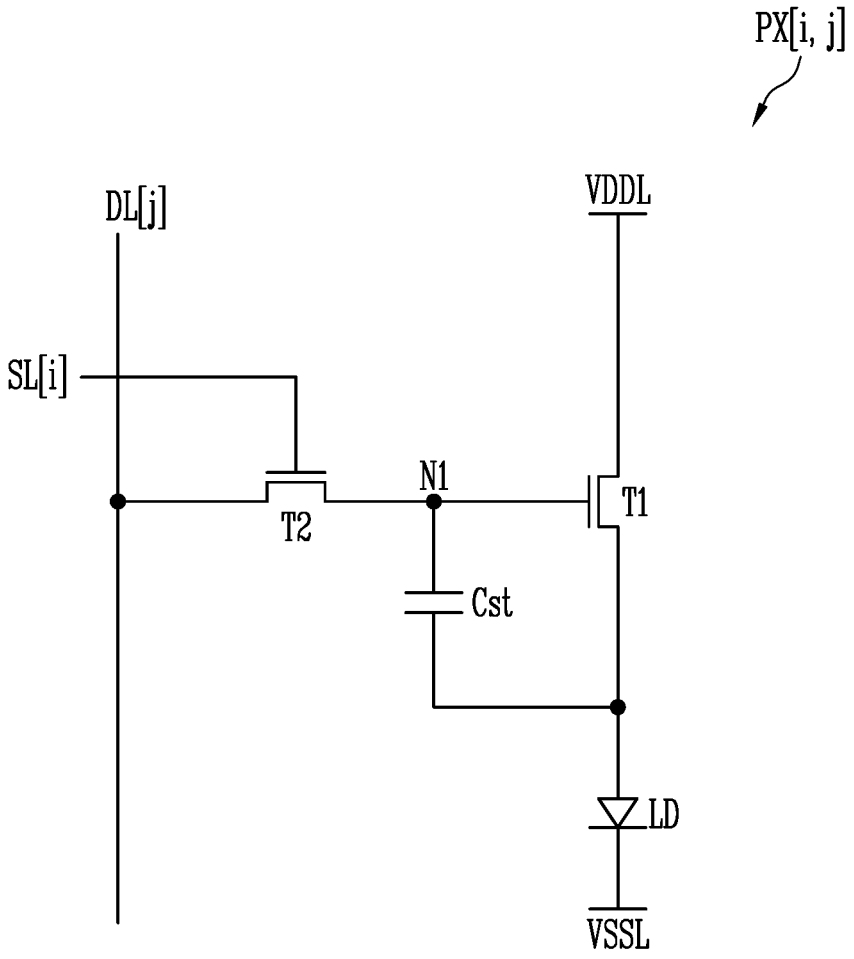
FIG. 2 is a circuit diagram illustrating a pixel according to some embodiments of the present disclosure.

FIG. 2 is a circuit diagram for explaining a pixel according to some embodiments of the present disclosure.

Although the pixel PX[i, j] located in the i-th row and the j-th column is described as an example in FIG. 2, other pixels may be configured in the same manner.

Referring to FIG. 2, the pixel PX[i, j] may include a first transistor T1, a second transistor T2, a storage capacitor Cst, and a light emitting element LD.

The first transistor T1 may be connected between the first power source line VDDL and a first electrode of the light emitting element LD, and may include a gate electrode connected to a first node N1. The first transistor T1 may be referred to as a driving transistor.

The second transistor T2 may be connected between the data line DL[j] and the first node N1, and may include a gate electrode connected to the scan line SL[i]. The second transistor T2 may be referred to as a scan transistor.

The light emitting element LD may be connected between a first electrode of the first transistor T1 and the second power source line VSSL. For example, an anode electrode of the light emitting element LD may be connected to the first electrode of the first transistor T1, and a cathode electrode of the light emitting element LD may be connected to the second power source line VSSL. The light emitting element LD may be an organic light emitting diode, an inorganic light emitting diode, a quantum dot light emitting diode, or the like.

When the scan signal of a turn-on level (for example, a high level) is supplied to the scan line SL[i], the second transistor T2 may be turned on. At this time, the data signal supplied to the data line DL[j] may be transferred to the first node N1, and the data signal may be stored in the storage capacitor Cst.

The driving current corresponding to a voltage difference between a first electrode and a second electrode of the storage capacitor Cst may flow between the first electrode and a second electrode of the first transistor T1. The light emitting element LD may emit light at a luminance corresponding to the driving current supplied from the first transistor T1.

Next, when the scan signal of a turn-off level (for example, a low level) is applied to the scan line SL[i], the second transistor T2 may be turned off. Therefore, the data line DL[j] and the first electrode of the storage capacitor Cst may be electrically separated, insulated, or isolated from each other. Even if the data voltage of the data line DL[j] changes, a voltage stored in the storage capacitor Cst may not be changed (e.g., may remain relatively constant).

Meanwhile, the global current GC sensed by the current sensor 15 according to FIG. 1 may be a sum of all driving currents collectively flowing through the first transistors T1 in the pixels. At this time, the driving current may be determined according to the data signal (or the data voltage) applied through the data line DL[j]. The data signal may be a signal corresponding to the image data mRGB supplied from the timing controller 11. Because the image data mRGB is scaled by the scale factor SF, the driving current flowing in each of the pixels may be adjusted by the scale factor SF.

In FIG. 2, the first transistor T1 and the second transistor T2 are shown as n-type transistors. However, when the polarity of a voltage applied to the gate electrode is changed (e.g., when a waveform of a corresponding signal is reversed), at least one of the first transistor T1 and the second transistor T2 may be changed to a p-type transistor.

In addition, only two transistors T1 and T2 are shown in FIG. 2, but the present disclosure is not limited thereto. For example, the pixel PX[i, j] may further include a transistor that is turned on by an emission control signal to electrically connect the second electrode of the first transistor T1 and the anode electrode of the light emitting element LD. In addition, the pixel PX[i, j] may further include a sensing transistor that is turned on by a sensing signal supplied through a separate sensing line to sense a voltage or current applied to the second electrode of the first transistor T1 or to the anode electrode of the light emitting element LD, and to transfer the sensed voltage or current to the sensing line.

Figure 3:
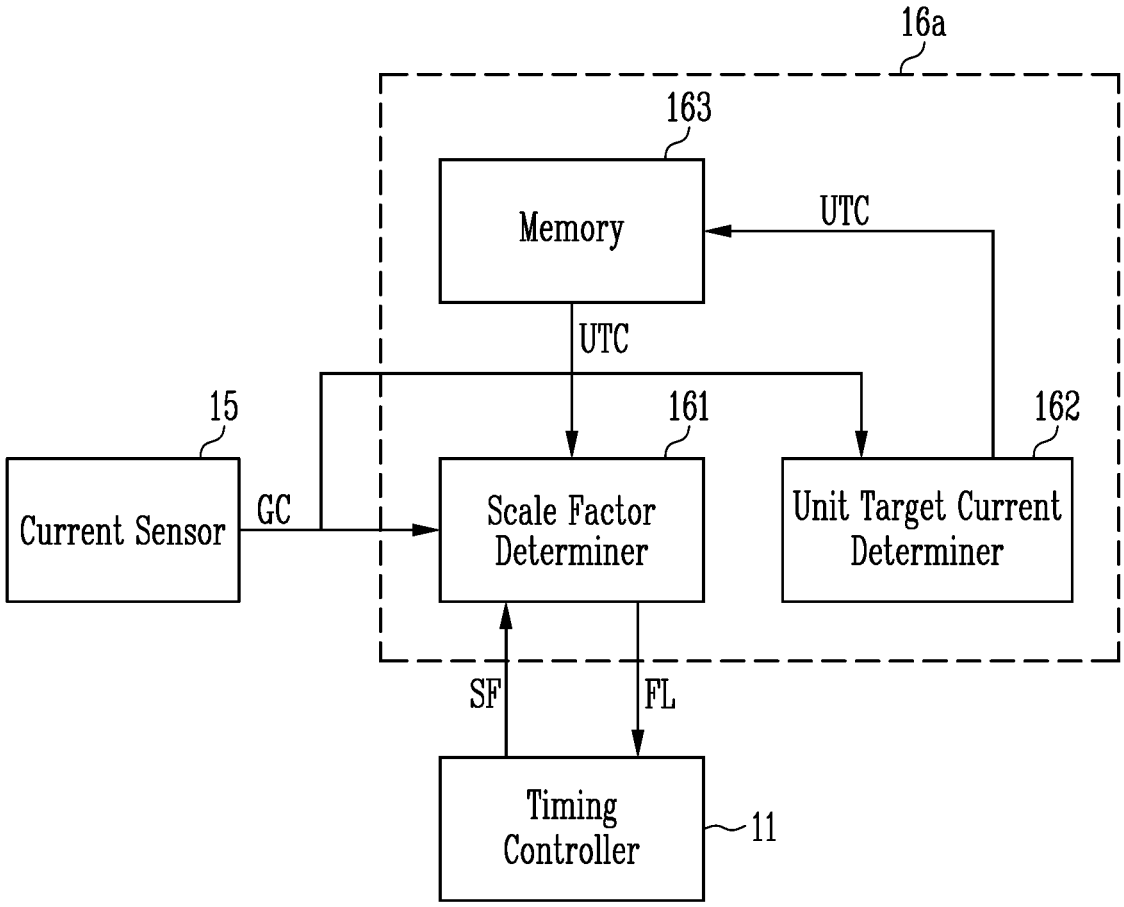
FIG. 3 is a block diagram illustrating a scale factor provider according to some embodiments of the present disclosure.
Figure 4A:
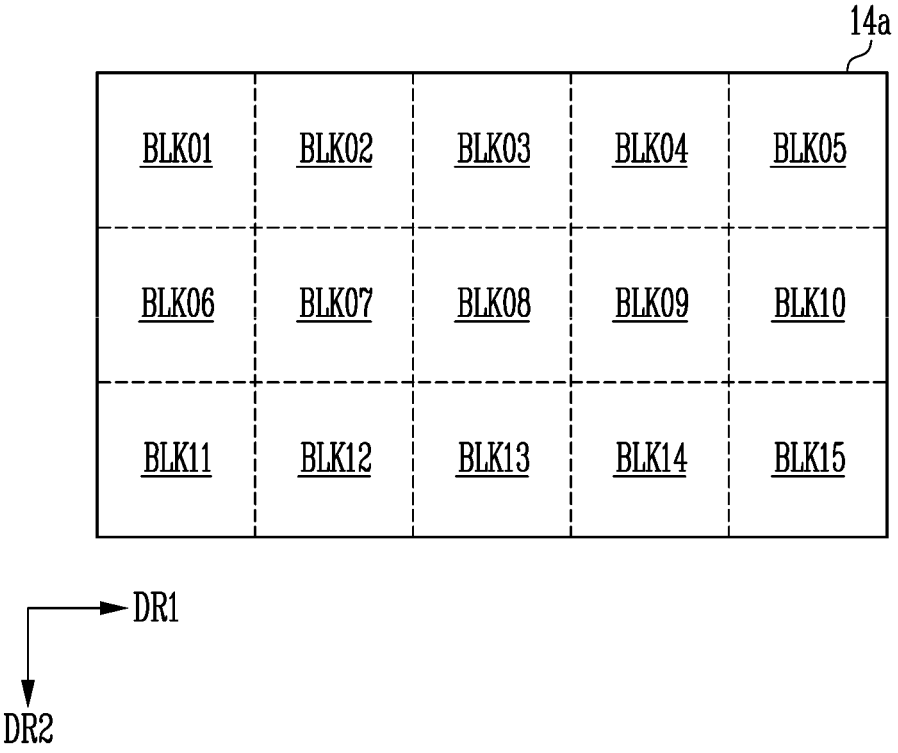
FIGS. 4A and 4B are conceptual views illustrating blocks dividing a display according to some embodiments of the present disclosure.
Figure 4B:
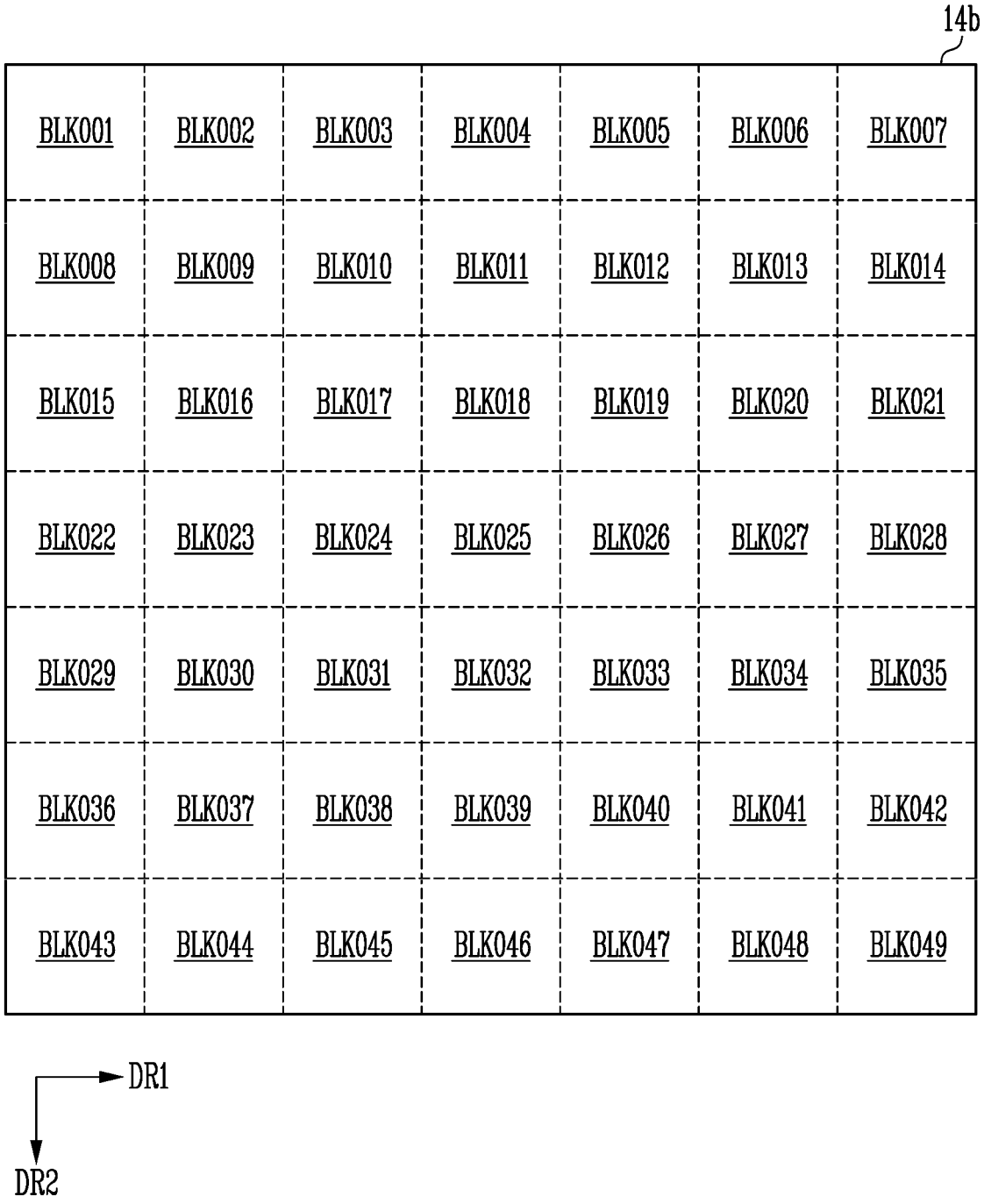

FIG. 3 is a block diagram illustrating a scale factor provider according to some embodiments of the present disclosure. FIGS. 4A and 4B are conceptual views illustrating blocks (e.g., unit blocks) dividing a display according to some embodiments of the present disclosure.

Referring to FIG. 3, a scale factor provider 16*a* may include a scale factor determiner 161, a unit target current determiner 162, and a memory 163.

The unit target current determiner 162 may determine the unit target current UTC using a reference block BLKR (refer to FIG. 5), and may store the determined unit target current UTC in the memory 163. Here, the unit target current UTC may be the global current GC obtained by the current sensor 15 when the image frame corresponding to a unit frame load (for example, 1%) is displayed on the display 14. The reference block BLKR may be a block having the pixels emitting light (for example, the pixels emitting light at the maximum grayscale value) to display the image frame corresponding to the unit frame load.

The scale factor determiner 161 may determine the target current based on the unit target current UTC received from the memory 163 and the frame load FL received from the timing controller 11, and may determine the scale factor SF by comparing the determined target current with the global current GC received from the current sensor 15. For example, the scale factor determiner 161 may determine the target current by multiplying the frame load FL and the unit target current UTC. Also, the scale factor determiner 161 may determine a ratio between the target current and the global current GC as the scale factor SF. In addition, the scale factor determiner 161 may calculate the scale factor SF to be greater than 1 when the target current is greater than the global current GC, and may calculate the scale factor SF to be less than 1 (e.g., less than 100%) when the target current is less than the global current GC.

Meanwhile, to determine the unit target current UTC, the unit target current determiner 162 may display the image frame corresponding to the unit frame load on the display 14. To this end, the display 14 may be divided into a plurality of blocks.

Referring to FIG. 4A, a display 14*a* divided into 15 blocks BLK01, BLK02, . . . , and BLK15 is shown. Referring to FIG. 4B, a display 14*b* divided into 49 blocks BLK001, BLK002, . . . , and BLK049 is shown.

Referring to FIG. 4A, each of the blocks BLK01, BLK02, . . . , and BLK15 may include one or more pixels. At this time, the blocks BLK01, BLK02, . . . , and BLK15 may include the same number of pixels, but the present disclosure is not limited thereto. For example, all or some of the blocks BLK01, BLK02, . . . , and BLK15 may share one or more pixels, and some of the blocks BLK01, BLK02, . . . , and BLK15 may include a larger number of pixels than other blocks.

In FIG. 4A, the display 14*a* is divided into five blocks in a first direction DR1 and three blocks in a second direction DR2 (which may be a direction that is substantially perpendicular to the first direction). FIG. 4A shows the display 14*a* divided into a total of 15 blocks, but the present disclosure is not limited thereto. For example, as shown in FIG. 4B, the display 14*b* is divided into seven blocks in the first direction DR1 and seven blocks in the second direction DR2. FIG. 4B shows the display 14*b* divided into a total of 49 blocks.

Figure 5:
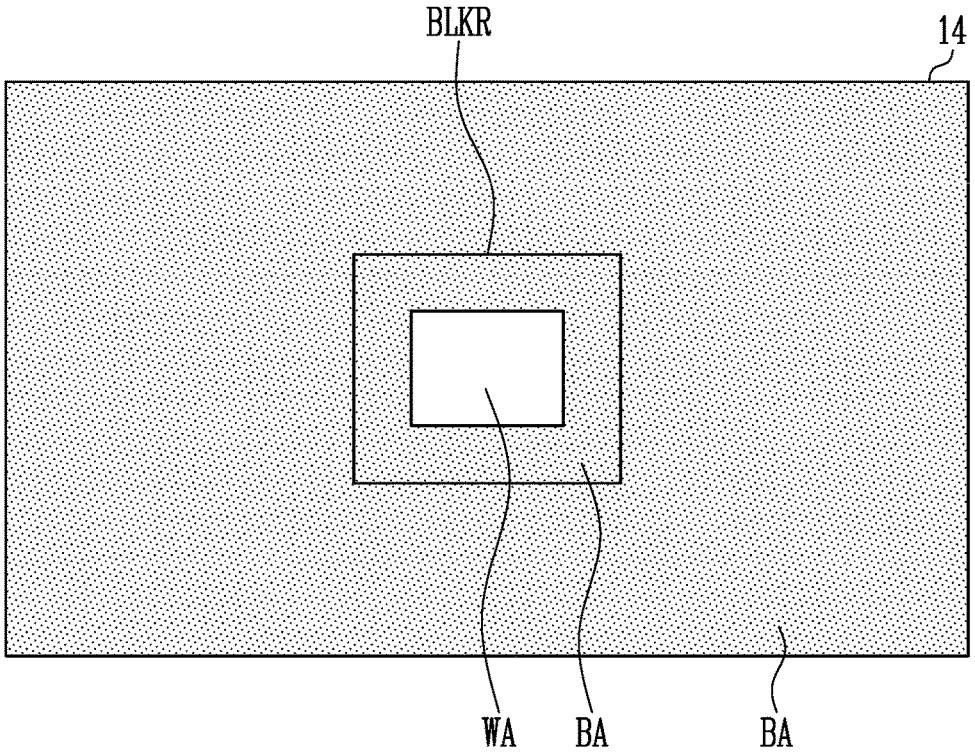
FIG. 5 is a conceptual view for explaining a method of determining a unit target current according to some embodiments of the present disclosure.

FIG. 5 is a conceptual view for explaining a method of determining a unit target current according to some embodiments of the present disclosure.

Referring to FIG. 5, FIG. 5 shows an example view determining a unit target current by selecting a block (for example, BLK08 in FIG. 4A, or BLK025 in FIG. 4B), which is located in a center among a plurality of blocks dividing the display 14, as the reference block BLKR.

To determine the unit target current, the reference block BLKR may be indicated by a white area WA having a box shape, and by a black area BA comprising a remaining portion of the reference block BLKR.

Here, the white area WA located in the center of the reference block BLKR may be an area corresponding to the unit frame load. The size of the white area WA may be the same as the size of the reference block BLKR in some embodiments, or may be smaller than the size of the reference block BLKR as shown in FIG. 5.

For example, when the white area WA included in the reference block BLKR is displayed in a white grayscale (or a maximum grayscale value), and the black area BA included in the remaining areas of the reference block BLKR excluding the white area WA is displayed in a black grayscale (or grayscale value 0), the frame load may be 1%, that is, the unit frame load.

Accordingly, when the image frame having the unit frame load shown in FIG. 5 is displayed on the display 14, the unit target current determiner 162 may determine the global current GC obtained by the current sensor 15 as the unit target current UTC.

When the display device 10 is first turned on, or before the display device 10 is shipped from a factory, the unit target current determiner 162 may be operated to determine the unit target current UTC, and to store the determined unit target current UTC in the memory 163.

As described above, when the image frame having the unit frame load is displayed on the display 14, a block including the white area WA, or a block including an area in which the grayscale value is not 0, may be the reference block BLKR for determining the unit target current UTC. For example, the reference block BLKR may be the block located in the center of the display 14, but the present disclosure is not limited thereto. For example, the reference block BLKR may be one of blocks arranged at an edge of the display 14 or one of blocks arranged at a corner.

On the other hand, when determining one of the plurality of blocks included in the display 14 as the reference block BLKR, as a premise or in theory, luminous efficiency between the blocks should be constant or substantially constant. For example, when the luminous efficiency between the blocks is different from each other, as the reference block BLKR is changed, the unit target current UTC is changed, and an error may occur in the global current management (GCM).

Figure 6:
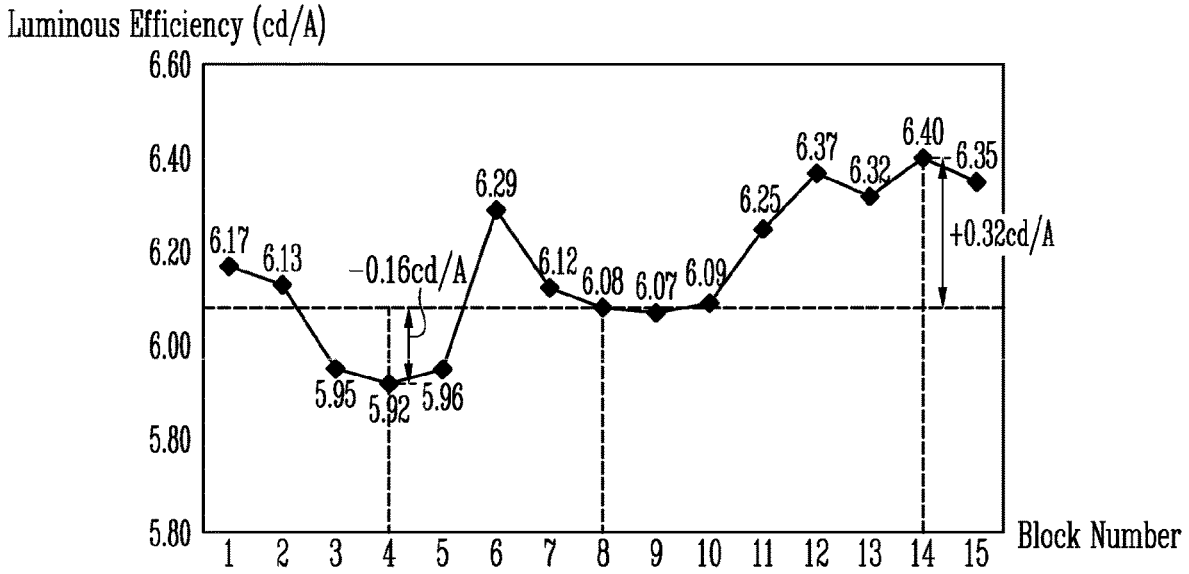
FIG. 6 is a graph comparing luminous efficiency in each of the blocks according to FIG. 4A.

FIG. 6 is a graph comparing luminous efficiency in each of the blocks according to FIG. 4A.

Referring to FIG. 6, a graph illustrating the result of measuring the luminous efficiency for each of the blocks BLK01, BLK02, BLK03, . . . , and BLK15 according to FIG. 4A is shown. Luminous efficiencies (cd/A) defined by a vertical axis of the graph shown in FIG. 6 refer to luminous intensity (cd) compared to current (A) that is suitable for each of the blocks to emit light with a luminance of about 500 nit.

As shown in FIG. 5, when the unit target current UTC is determined using the block BLK08 located at the center of the display 14*a* according to FIG. 4A as the reference block BLKR, a problem in which the unit target current UTC is changed according to the luminous efficiency of the block BLK08 located at the center may occur.

When all of the blocks BLK01, BLK02, . . . , and BLK15 according to FIG. 4A have the same luminous efficiency, the unit target current UTC may always be substantially constant. However, when the blocks BLK01, BLK02, . . . , and BLK15 have different luminous efficiencies, the unit target current UTC may vary depending on which block is used as the reference block to determine the unit target current UTC.

It should be noted that, in referring to FIG. 6, all of the blocks BLK01, BLK02, . . . , and BLK15 have different luminous efficiencies. For example, the luminous efficiency of the block BLK08 located at the center is about 6.08 cd/A. However, the luminous efficiency of a fourth block BLK04 is about 5.92 cd/A, and the luminous efficiency is smaller than the luminous efficiency of the block BLK08 located at the center by about 0.16 cd/A. In addition, the luminous efficiency of a fourteenth block BLK14 (e.g., about 6.40 cd/A) is greater than the luminous efficiency of the block BLK08 located at the center by about 0.32 cd/A.

As described above, a difference in luminous efficiency may occur for each of the blocks BLK01, BLK02, . . . , and BLK15. Therefore, to perform the global current management (GCM) relatively consistently regardless of the position in the display 14, the unit target current UTC should be determined in consideration of the difference in luminous efficiency between the blocks BLK01, BLK02, . . . , and BLK15.

Figure 7:
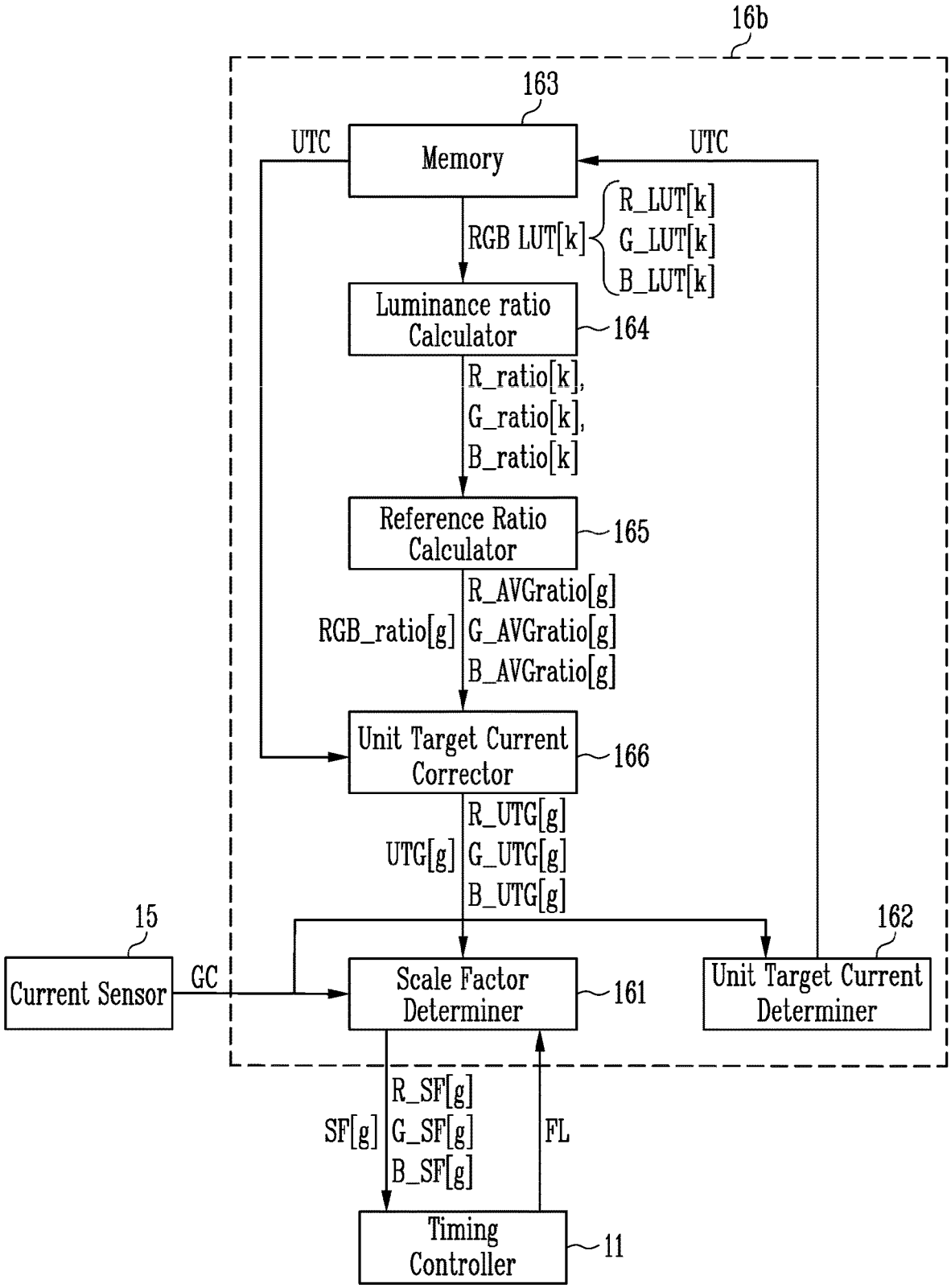
FIG. 7 is a block diagram illustrating a scale factor provider according to other embodiments of the present disclosure.

FIG. 7 is a block diagram illustrating a scale factor provider according to other embodiments of the present disclosure. FIG. 8 is an example view illustrating an RGB lookup table according to some embodiments of the present disclosure.

Referring to FIG. 7, unlike the scale factor provider 16*a* shown in FIG. 3, a scale factor provider 16*b* according to other embodiments of the present disclosure may further perform a procedure of correcting the unit target current UTC based on a deviation in light emitting characteristics between the plurality of blocks dividing the display 14.

The scale factor provider 16*b* may include the scale factor determiner 161, the unit target current determiner 162, the memory 163, a luminance ratio calculator 164, a reference ratio calculator 165, and/or a unit target current corrector 166.

As shown in FIG. 3, the unit target current determiner 162 may determine the unit target current UTC using the reference block BLKR, and may store the determined unit target current UTC in the memory 163.

The memory 163 may previously store a plurality of RGB lookup tables RGB LUT[k] that individually define luminance levels according to the grayscale values for each of the blocks, where k is a natural number that is less than or equal to the number of blocks, and that is 1 or more. Here, each of the RGB lookup tables RGB LUT[k] may be a table that defines a luminance level according to a grayscale value for each of red, green, and blue grayscales.

For example, referring to FIG. 8, an RGB lookup table RGB LUT[k] for any k-th block is shown. The RGB lookup table RGB LUT[k] may include a red grayscale table R_LUT[k] defining the luminance level according to the red grayscale value, a green grayscale table G_LUT[k] defining the luminance level according to the green grayscale value, and a blue grayscale table B_LUT[k] defining the luminance level according to the blue grayscale value. In FIG. 8, the index indicates the red grayscale value, the green grayscale value, and the blue grayscale value, and the component values may be the luminance levels. Here, each of the luminance levels may mean a level of the data signal (or data voltage) supplied to the pixels included in the k-th block.

In FIG. 8, the red grayscale table R_LUT[k], the green grayscale table G_LUT[k], and the blue grayscale table B_LUT[k] defining the luminance levels according to 64 grayscale values (e.g., 4 byte or 32 bit) are shown, but this should be understood as being simply an example. In other embodiments, the luminance levels may be defined for 255 red grayscale values, green grayscale values, and blue grayscale values (e.g., 8 bit), and the luminance levels defined for 64 red grayscale values, green grayscale values, and blue grayscale values may be interpolated to extend to the luminance levels for the 255 red grayscale values, green grayscale values, and blue grayscale values.

The plurality of RGB lookup tables RGB LUT[k] defining the luminance levels according to the grayscale values for each of the blocks may be generated in advance for each of the blocks in the processes including luminance color compensation (LCC) and the like, and may be stored in the memory 163 before the display device 10 is shipped from the factory.

Accordingly, the scale factor provider 16*b* may correct the unit target current UTC by referring to the plurality of RGB lookup tables RGB LUT[k].

For example, the unit target current corrector 166 may correct the unit target current UTC by a reference ratio R_AVGratio[g], G_AVGratio[g], and B_AVGratio[g] or RGB_ratio[g] determined by referring to the plurality of RGB lookup tables RGB LUT[k] to generate the corrected unit target current UTC[g], where g is a natural number greater than 1 and less than or equal to the maximum grayscale value.

The luminance ratio calculator 164 may calculate a luminance level ratio R_ratio[k], G_ratio[k], and B_ratio[k] for each of the blocks by comparing the reference lookup table defined for the reference block BLKR among the plurality of RGB lookup tables RGB LUT[k] with the RGB lookup tables R_LUT [k], G_LUT [k], and B_LUT [k], respectively.

Here, the luminance level ratio may be a ratio between a luminance level defined in the reference lookup table and a luminance level defined in each of the RGB lookup tables RGB LUT[k].

For example, the luminance level ratio according to a grayscale value 5 may be calculated by calculating the luminance level according to the grayscale value 5 defined in each of the RGB lookup tables RGB LUT[k] compared to the luminance level according to the grayscale value 5 defined in the reference lookup table. As such, the luminance level ratio may be calculated for each of the grayscale values (for example, indexes 1 to 64 in FIG. 8) defined in each of the RGB lookup tables RGB LUT[k]. Accordingly, the luminance level ratio may have a meaning corresponding to a ratio representing the deviation in light emitting characteristics between the blocks.

In more detail, the luminance level ratio may be calculated for each of the red grayscale values, blue grayscale values, and green grayscale values defined in the RGB lookup tables. Therefore, the luminance level ratio may include a first luminance level ratio R_ratio[k] calculated for the red grayscale value, a second luminance level ratio G_ratio[k] calculated for the green grayscale value, and a third luminance level ratio B_ratio[k] calculated for the blue grayscale value.

For example, the first luminance level ratio R_ratio[k] corresponding to an arbitrary k-th block may be calculated as shown in Equation 1 below.

$$\text{R_ratio}[k] = \frac{\text{R_LUT}[k]}{\text{R_LUT}[25]} \qquad \text{Equation 1}$$

In Equation 1, R_LUT[25] may be the luminance level of the red grayscale table for the reference block BLKR when a 25th block BLK[025] located at the center is determined as the reference block BLKR as shown in FIG. 4B, and R_LUT[k] may be the luminance level of the red grayscale table for the arbitrary k-th block. Equation 1 may be calculated for the red grayscale values, respectively.

For example, the second luminance level ratio G_ratio[k] corresponding to the arbitrary k-th block may be calculated as shown in Equation 2 below.

$$\text{G_ratio}[k] = \frac{\text{G_LUT}[k]}{\text{G_LUT}[25]} \qquad \text{Equation 2}$$

Referring to Equation 2, G_LUT[25] may be the luminance level of the green grayscale table for the reference block BLKR when the 25th block BLK[025] located at the center is determined as the reference block BLKR as shown in FIG. 4B, and G_LUT[k] may be the luminance level of the green grayscale table for the arbitrary k-th block. Equation 2 may be calculated for the green grayscale values, respectively.

For example, the third luminance level ratio B_ratio[k] corresponding to the arbitrary k-th block may be calculated as shown in Equation 3 below.

$$\text{B_ratio}[k] = \frac{\text{B_LUT}[k]}{\text{B_LUT}[25]} \qquad \text{Equation 3}$$

Referring to Equation 3, B_LUT[25] may be the luminance level of the blue grayscale table for the reference block BLKR when the 25th block BLK[025] located at the center is determined as the reference block BLKR as shown in FIG. 4B, and B_LUT[k] may be the luminance level of the blue grayscale table for the arbitrary k-th block. Equation 3 may be calculated for the blue grayscale values, respectively.

The reference ratio calculator 165 may calculate the reference ratio R_AVGratio[g], G_AVGratio[g], and B_AVGratio[k] by using the luminance level ratio R_ratio [k], G_ratio[k], and B_ratio[k] calculated for each of the blocks.

The reference ratio may include an intermediate value or an average value of the luminance level ratio R_ratio[k], G_ratio[k], and B_ratio[k] calculated for each of the blocks.

More specifically, the reference ratio may include a first reference ratio R_AVGratio[g] calculated using the first luminance level ratio R_ratio[k], a second reference ratio G_AVGratio[g] calculated using the second luminance level ratio G_ratio[k], and a third reference ratio B_AVGratio[g] calculated using the third luminance level ratio B_ratio[k].

For example, the first reference ratio R_AVGratio[g] may be the average value or the intermediate value of the first luminance level ratio R_ratio[k] for all of the blocks, the second reference ratio G_AVGratio[g] may be the average value or the intermediate value of the second luminance level ratio G_ratio[k] for all of the blocks, and the third reference ratio B_AVGratio[g] may be the average value or the intermediate value of the third luminance level ratio B_ratio[k] for all of the blocks.

The unit target current corrector 166 may generate the corrected unit target current UTG[g] by multiplying a unit target current UTG by the first reference ratio R_AVGratio [g], the second reference ratio G_AVGratio[g], and/or the third reference ratio B_AVGratio[g], respectively.

For example, a corrected first unit target current R_UTG [g] may be generated by multiplying the first reference ratio R_AVGratio[g] by the unit target current UTG, a corrected second unit target current G_UTG[g] may be generated by multiplying the second reference ratio G_AVGratio[g] by the unit target current UTG, and a corrected third unit target current B_UTG[g] may be generated by multiplying the third reference ratio B_AVGratio[g] by the unit target current UTG.

The scale factor determiner 161 may calculate a first target current by multiplying the corrected first unit target current R_UTG[g] by the frame load FL, and may calculate a first scale factor R_SF[g] by comparing the calculated first target current with the global current GC. The timing controller 11 may scale the red grayscale values of the input image data RGB using the first scale factor R_SF[g].

The scale factor determiner 161 may calculate a second target current by multiplying the corrected second unit target current G_UTG[g] by the frame load FL, and may calculate a second scale factor G_SF[g] by comparing the calculated second target current with the global current GC. The timing controller 11 may scale the green grayscale values of the input image data RGB using the second scale factor G_SF [g].

The scale factor determiner 161 may calculate a third target current by multiplying the corrected third unit target current R_UTG[g] by the frame load FL, and may calculate a third scale factor B_SF[g] by comparing the calculated third target current with the global current GC. The timing controller 11 may scale the blue grayscale values of the input image data RGB using the third scale factor B_SF[g].

On the other hand, as another example, the reference ratio calculator 165 may determine an RGB average ratio RGB_ratio[g] calculated by averaging the first reference ratio R_AVGratio[g], the second reference ratio G_AVGratio[g], and the third reference ratio B_AVGratio[g] as the reference ratio.

For example, the RGB average ratio RGB_ratio[g] for an arbitrary grayscale value g may be calculated as shown in Equation 4 below.

$$\text{RGB_ratio}[g] = \frac{\text{R_AVGratio}[g] + \text{G_AVGratio}[g] + \text{B_AVGratio}[g]}{3} \quad \text{Equation 4}$$

Referring to Equation 4, the RGB average ratio RGB_ratio[g] for the arbitrary grayscale value g may be a value obtained by summing the first reference ratio R_AVGratio [g], the second reference ratio G_AVGratio[g], and the third reference ratio B_AVGratio[g], and dividing the sum by three.

As described above, when the RGB average ratio RGB_ratio[g] is used as the reference ratio, the scale factor SF[g] calculated according to the RGB average ratio RGB_ratio[g] may be applied to the grayscale values of the input image data without distinguishing the red grayscale, green grayscale, and blue grayscale of the input image data.

For example, the unit target current corrector 166 may generate the corrected unit target current UTG[g] by multiplying the RGB average ratio RGB_ratio[g] by the unit target current UTG.

In this case, the scale factor determiner 161 may calculate the target current by multiplying the corrected unit target current UTG[g] and the frame load FL, and may compare the calculated target current with the global current GC to calculate the scale factor SF[g]. The timing controller 11 may scale the grayscale values of the input image data RGB using the scale factor SF[g].

According to the above-described embodiments, because the reference ratio according to some embodiments of the present disclosure is calculated for each of the grayscale values, the corrected unit target current may also be determined for each of the grayscale values. Therefore, because the scale factor is also determined for each of the grayscale values, different scaling factors may be applied according to the grayscale values of the input image data. For example, a scale factor of 1.2 may be applied to the grayscale value 5 of the input image data, and a scale factor of 0.9 may be applied to a grayscale value 30 of the input image data.

In some embodiments of the present disclosure, because the RGB lookup tables RGB LUT[k] are used, in which the light emitting characteristics of each of the blocks are represented for each of the grayscale values, the unit target current UTG may be corrected to reduce or minimize the deviation in light emitting characteristics of all of the blocks, and a different scale factor SF[g] may be applied to each of the grayscale values. Therefore, the global current management (GCM) can be performed more precisely.

Figure 9A:
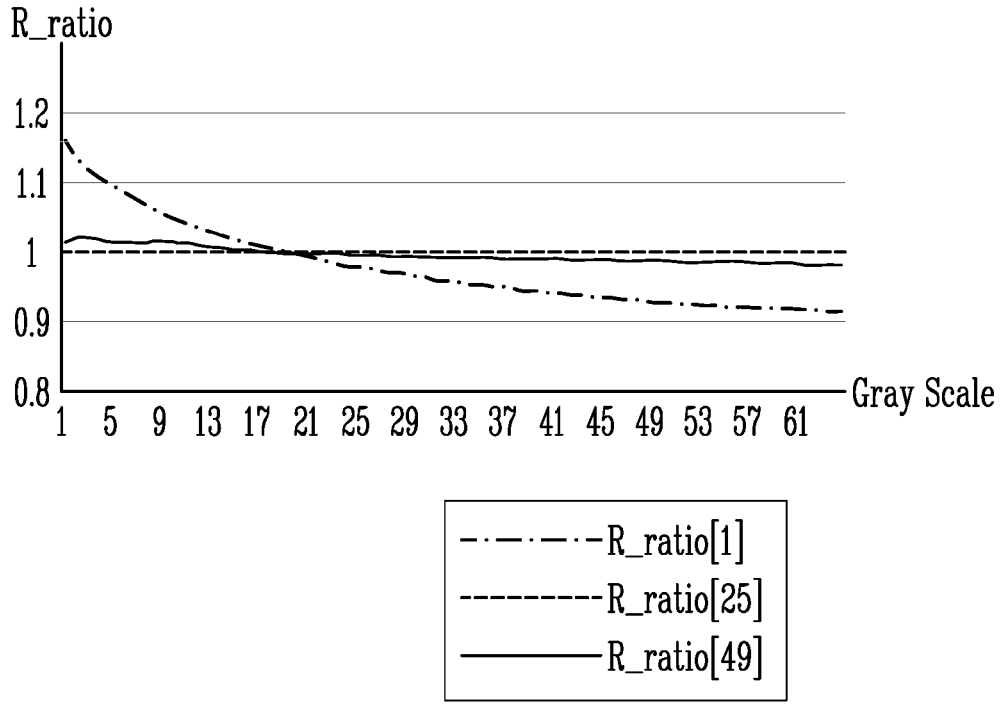
FIGS. 9A to 9C are graphs illustrating luminance level ratios according to grayscale values.
Figure 9B:
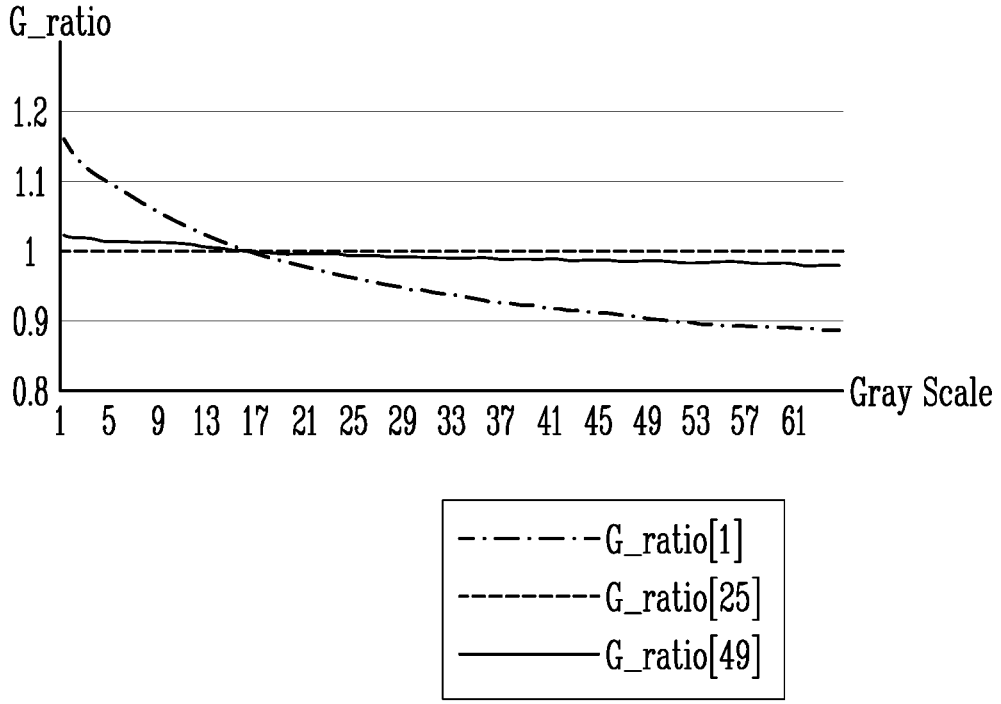
Figure 9C:
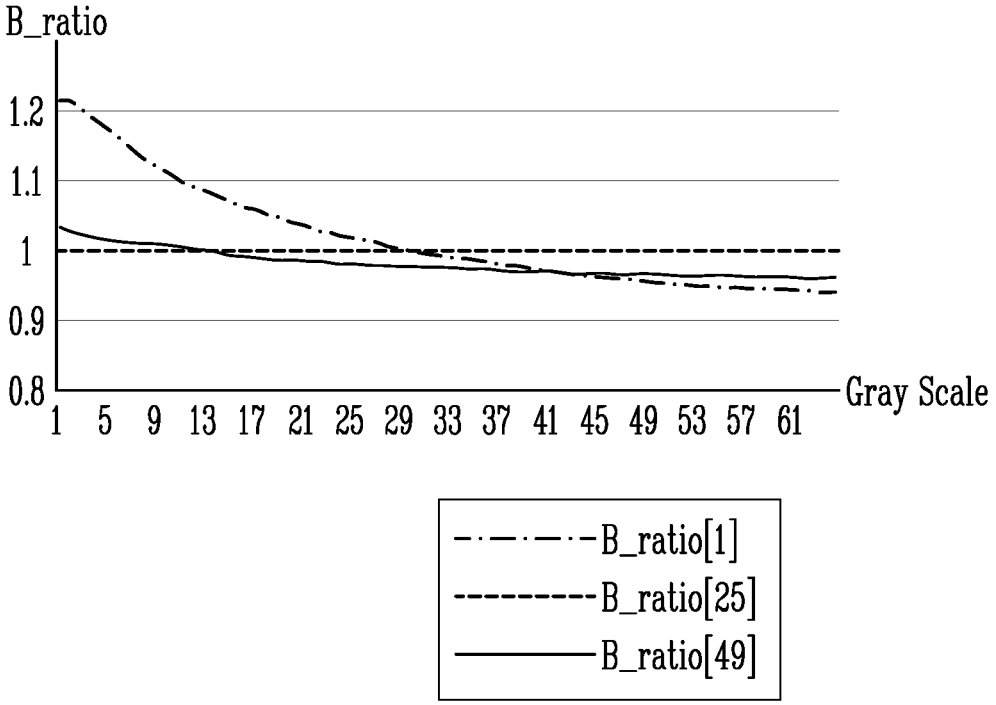

FIGS. 9A to 9C are graphs illustrating luminance level ratios according to grayscale values.

Referring to FIG. 9A, a graph illustrating the luminance level ratio according to the red grayscale value is shown. Referring to FIG. 9B, a graph illustrating the luminance level ratio according to the green grayscale value is shown. Referring to FIG. 9C, a graph illustrating the luminance level ratio according to the blue grayscale value is shown.

In FIGS. 9A to 9C, the horizontal axis represents the red grayscale value, the green grayscale value, and the blue grayscale value, respectively, and the vertical axis represents a ratio between the luminance level of the reference block BLKR and the luminance level of each of the blocks.

In FIGS. 9A to 9C, assuming that the 25th block BLK025 located at the center in the display 14*b* according to FIG. 4B is the reference block BLKR, the first to third luminance level ratios R-ratio[1], G-ratio[1], and B-ratio[1] to the first block BLK001 in FIG. 4B, the first to third luminance level ratios R-ratio[25], G-ratio[25], and B-ratio[25] to the 25th block BLK025 in FIG. 4B, and the first to third luminance level ratios R-ratio[49], G-ratio[49], and B-ratio[49] to the 49th block BLK049 in FIG. 4B, may be calculated as an example.

The first to third luminance level ratios R_ratio[25], G_ratio[25], and B_ratio[25] for the 25th block BLK025 corresponding to the reference block BLKR may be all 1 for each grayscale value, as the comparison targets are the same.

Referring to the graphs shown in FIGS. 9A to 9C, each block may have a different luminance level ratio. That is, the luminance level ratio obtained by comparing the luminance level of the reference block BLKR with the luminance levels of the other blocks may indicate the light emitting characteristics of each block compared with the reference block BLKR.

In addition, as shown in FIGS. 9A to 9C, because the luminance level ratio according to some embodiments of the present disclosure may be calculated for each of the grayscale values, the deviation in light emitting characteristics of each pixel in the blocks according to the grayscale values can also be considered.

In addition, even when using the same block shown in FIGS. 9A to 9C, deviations may be different from each other depending on the luminance level ratios of the red grayscale, the green grayscale, and the blue grayscale. Therefore, in some embodiments of the present disclosure, the deviation in light emitting characteristics between the red grayscale, the green grayscale, and the blue grayscale can be further considered.

Figure 10:
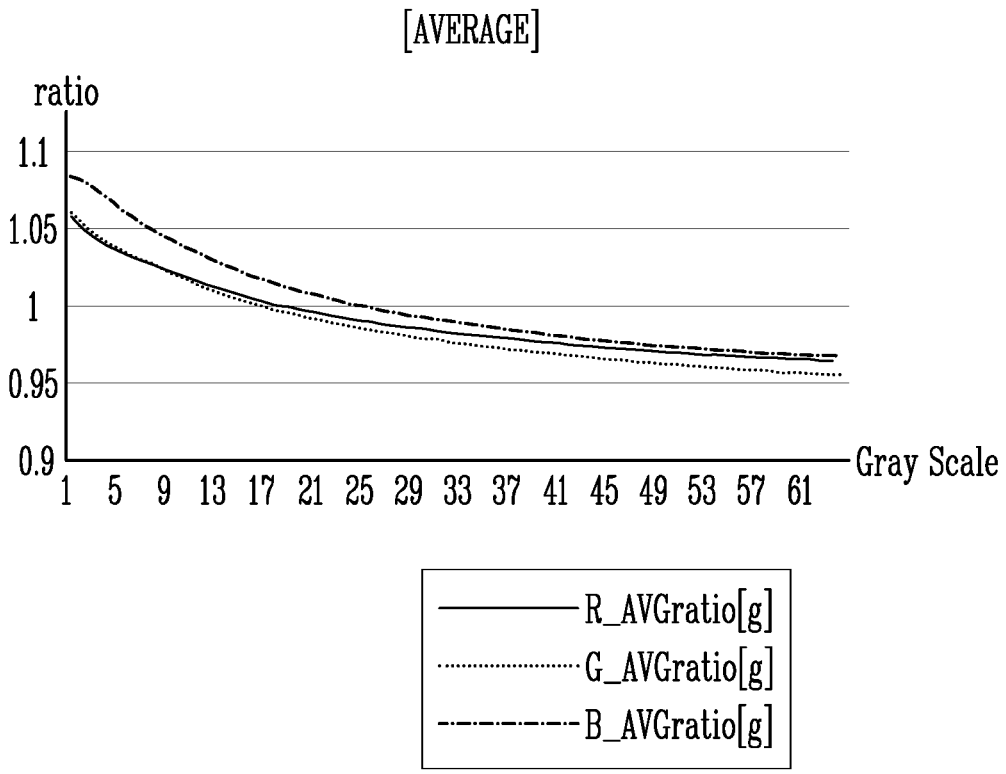
FIG. 10 is a graph illustrating a reference ratio according to a grayscale value according to some embodiments of the present disclosure.
Figure 11:
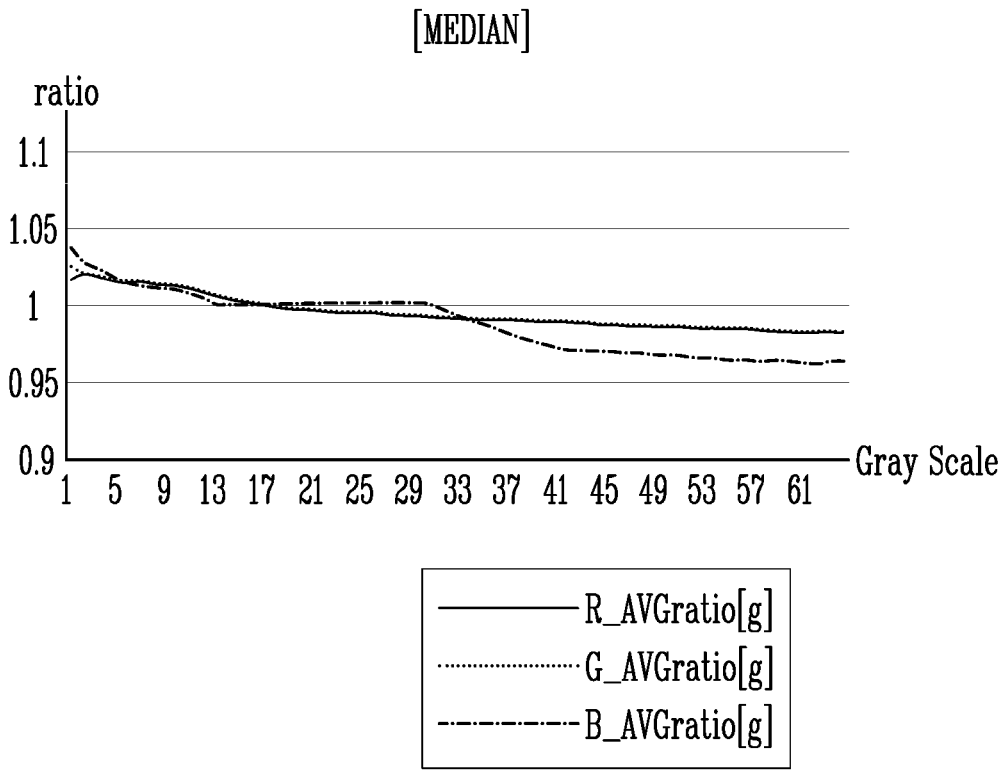
FIG. 11 is a graph illustrating a reference ratio according to a grayscale value according to other embodiments of the present disclosure.

FIG. 10 is a graph illustrating a reference ratio according to a grayscale value according to some embodiments of the present disclosure. FIG. 11 is a graph illustrating a reference ratio according to a grayscale value according to other embodiments of the present disclosure.

Referring to FIG. 10, the first reference ratio R-AVGratio [g] calculated by averaging first luminance level ratios R-ratio[k] calculated for all of the blocks BLK001 to BLK049 of the display 14*b* according to FIG. 4B, as well as the luminance level ratios of the blocks BLK001, BLK025, and BLK049 shown in FIG. 9A for each grayscale value, the second reference ratio G-AVGratio[g] calculated by averaging second luminance level ratios G-ratio[k] calculated for all of the blocks BLK001 to BLK049 for each grayscale value, and the third reference ratio B-AVGratio[g] calculated by averaging third luminance level ratios B-ratio[k] calculated for all of the blocks BLK001 to BLK049 for each grayscale value, are shown.

Referring to FIG. 11, the first reference ratio R-AVGratio [g] calculated by taking the intermediate value for the first luminance level ratios R-ratio[k] calculated for all of the blocks BLK001 to BLK049 of the display 14*b* according to FIG. 4B, as well as the luminance level ratios of the blocks BLK001, BLK025, and BLK049 shown in FIG. 9A for each grayscale value, the second reference ratio G-AVGratio[g] calculated by taking the intermediate value for the second luminance level ratios G-ratio[k] calculated for all of the blocks BLK001 to BLK049 for each grayscale value, and the third reference ratio B-AVGratio[g] calculated by taking the intermediate value for the third luminance level ratios B-ratio[k] calculated for all of the blocks BLK001 to BLK049 for each grayscale value, are shown.

For example, the first reference ratio to a red grayscale value 0 may be calculated by calculating the average value or the intermediate value of the luminance level ratios of all of the blocks determined with respect to the red grayscale value 0. The second reference ratio to a green grayscale value 5 may be calculated by calculating the average value or the intermediate value of the luminance level ratios of all of the blocks determined with respect to the green grayscale value 5. In addition, the third reference ratio to a blue grayscale value 41 may be calculated by calculating the average value or the intermediate value of the luminance level ratios of all of the blocks determined with respect to the blue grayscale value 41.

As shown in FIGS. 10 and 11, the scale factor provider 16*b* may calculate the reference ratio for correcting the unit target current UTG through the average value or the intermediate value for the luminance level ratios of all of the blocks. Therefore, a previous unit target current UTG may be corrected with the unit target current corresponding to the average or intermediate characteristics of all of the blocks to reduce or minimize the deviation in light emitting characteristics between the blocks.

Figure 12:
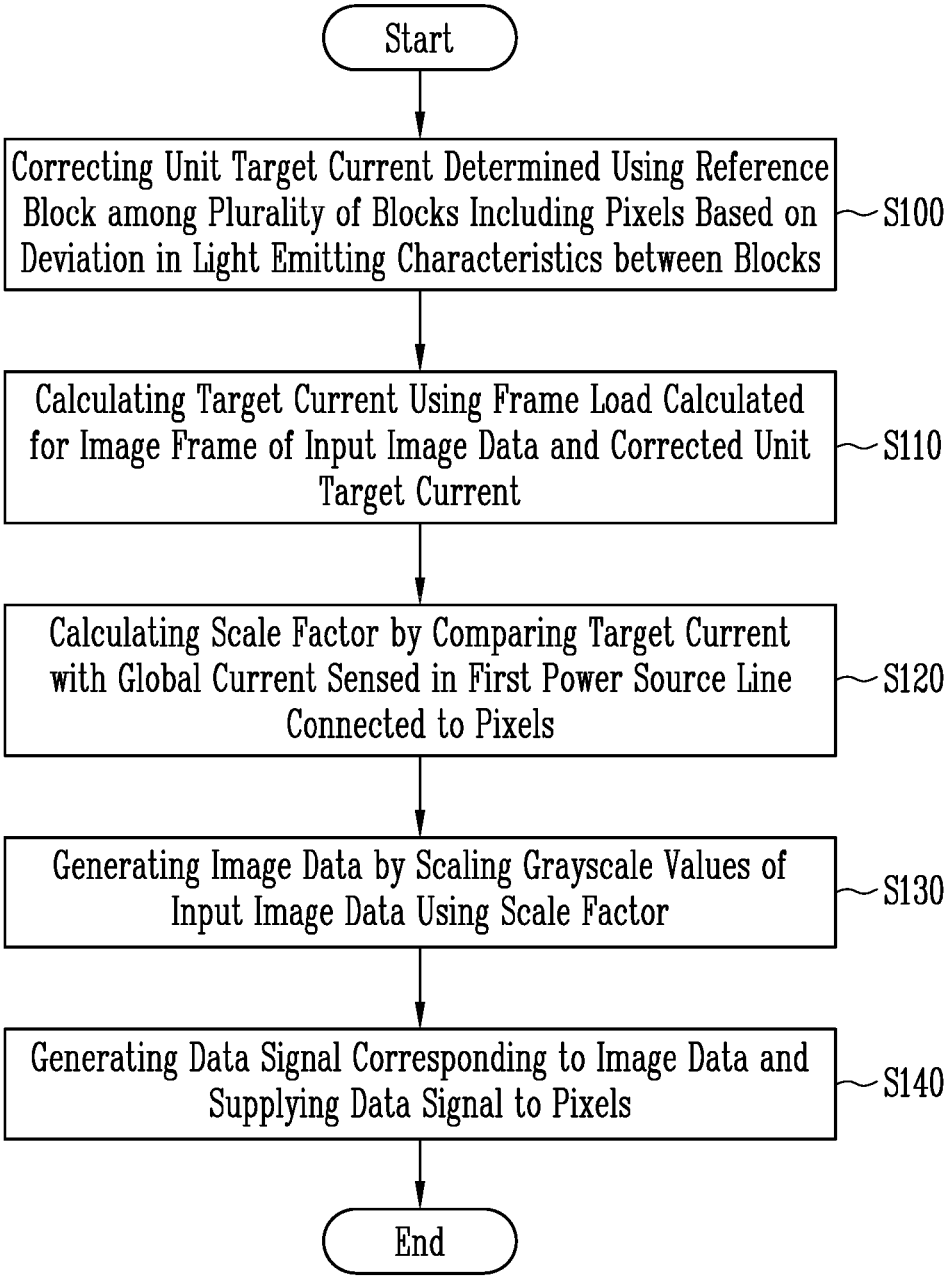
FIG. 12 is a flowchart illustrating a driving method of a display device according to some embodiments of the present disclosure.

FIG. 12 is a flowchart illustrating a driving method of a display device according to some embodiments of the present disclosure.

Referring to FIG. 12, a driving method of a display device may include: correcting a unit target current determined using a reference block among a plurality of blocks including pixels based on a deviation in light emitting characteristics between the blocks (S100); calculating a target current using a frame load calculated for an image frame of input image data and the corrected unit target current (S110); calculating a scale factor by comparing the target current with a global current sensed in a first power source line connected to the pixels (S120); generating image data by scaling grayscale values of the input image data using the scale factor (S130); and generating a data signal corresponding to the image data and supplying the data signal to the pixels (S140).

In the correcting the unit target current (S100), the unit target current may be corrected by a reference ratio determined by referring to a plurality of RGB lookup tables that individually define a luminance level according to the grayscale values for each of the blocks.

Correcting the unit target current (S100) may include comparing a reference lookup table defined for the reference block among the RGB lookup tables with the RGB lookup tables to calculate a luminance level ratio representing the deviation in light emitting characteristics for each of the blocks.

The luminance level ratio may be a ratio between a luminance level defined in the reference lookup table and a luminance level respectively defined in the RGB lookup tables.

Correcting the unit target current (S100) may include calculating the reference ratio using the luminance level ratio calculated for each of the blocks.

The reference ratio may include an intermediate value or an average value of the luminance level ratio calculated for each of the blocks.

The luminance level ratio may include a first luminance level ratio calculated for a red grayscale value, a second luminance level ratio calculated for a green grayscale value, and a third luminance level ratio calculated for a blue grayscale value.

The reference ratio may include a first reference ratio calculated using the first luminance level ratio, a second reference ratio calculated using the second luminance level ratio, and a third reference ratio calculated using the third luminance level ratio.

The display device may mean the display device 10 according to FIGS. 1 to 11. Therefore, in addition to the above-described operations (S100 to S140), the driving method of the display device should be interpreted to include operations of the components of the display device 10 described above with reference to FIGS. 1 to 11.

The display device and the driving method thereof according to some embodiments of the present disclosure may accurately control the amount of current by setting the target current for reducing the deviation in luminous efficiency between the blocks by using the RGB lookup table for each of the blocks of the display.

For example, when using the RGB lookup table for each of the blocks, the target current may be set in detail for each of the red grayscale, green grayscale, and blue grayscale, and the target current may be set differently for each step of the grayscale values.

The drawings referred to heretofore and the detailed description of the invention described above are merely illustrative of the invention. It is to be understood that the invention has been disclosed for illustrative purposes only and is not intended to limit the scope of the invention described in the claims. Therefore, those skilled in the art will appreciate that various modifications and equivalent embodiments are possible without departing from the scope of the invention. Accordingly, the true scope of the invention should be determined by the technical idea of the appended claims, with functional equivalents thereof to be included therein.

What is claimed is:

1. A display device comprising:

a display divided into a plurality of blocks comprising pixels;

a timing controller for calculating a frame load for an image frame of input image data, and for generating image data by scaling grayscale values of the input image data using a scale factor;

a data driver for generating a data signal corresponding to the image data, and for supplying the data signal to the pixels;

a current sensor for sensing a global current flowing in a first power source line connected to the pixels; and a scale factor provider for correcting a unit target current determined using a reference block among the blocks based on a deviation in light emitting characteristics between the blocks, for calculating a target current using the frame load and a corrected unit target current, and for comparing the target current with the global current to calculate the scale factor.

2. The display device of claim 1, wherein the scale factor provider comprises:

a unit target current determiner for determining the unit target current using the reference block;

a memory for storing a plurality of RGB lookup tables that individually define a luminance level according to the grayscale values for each of the blocks; and a unit target current corrector for correcting the unit target current by a reference ratio determined by referring to the RGB lookup tables to generate the corrected unit target current.

3. The display device of claim 2, wherein the scale factor provider further comprises:

a luminance ratio calculator for comparing a reference lookup table defined for the reference block among the plurality of RGB lookup tables with the RGB lookup tables to calculate a luminance level ratio for each of the blocks.

4. The display device of claim 3, wherein the luminance level ratio is a ratio between a luminance level defined in the reference lookup table and a luminance level respectively defined in the RGB lookup tables.

5. The display device of claim 3, wherein the scale factor provider further comprises:

a reference ratio calculator for calculating the reference ratio using the luminance level ratio calculated for each of the blocks.

6. The display device of claim 5, wherein the reference ratio comprises an intermediate value or an average value of the luminance level ratio calculated for the blocks.

7. The display device of claim 5, wherein the luminance level ratio comprises a first luminance level ratio calculated for a red grayscale value, a second luminance level ratio calculated for a green grayscale value, and a third luminance level ratio calculated for a blue grayscale value.

8. The display device of claim 7, wherein the reference ratio comprises a first reference ratio calculated using the first luminance level ratio, a second reference ratio calculated using the second luminance level ratio, and a third reference ratio calculated using the third luminance level ratio.

9. The display device of claim 8, wherein the reference ratio calculator determines an RGB average ratio calculated by averaging the first reference ratio, the second reference ratio, and the third reference ratio as the reference ratio.

10. The display device of claim 8, wherein the unit target current corrector is configured to multiply the first reference ratio and the unit target current to generate a corrected first unit target current, to multiply the second reference ratio and the unit target current to generate a corrected second unit target current, and to multiply the third reference ratio and the unit target current to generate a corrected third unit target current.

11. The display device of claim 10, wherein the scale factor provider is configured to calculate a first target current by multiplying the corrected first unit target current and the frame load, and to compare a calculated first target current with the global current to calculate a first scale factor, and wherein the timing controller is configured to scale red grayscale values of the input image data using the first scale factor.

12. The display device of claim 1, wherein the reference block is located in a center of the display.

13. A driving method of a display device, the method comprising:

correcting a unit target current determined using a reference block among a plurality of blocks comprising pixels based on a deviation in light emitting characteristics between the blocks;

calculating a target current using a frame load calculated for an image frame of input image data and a corrected unit target current;

calculating a scale factor by comparing the target current with a global current sensed in a first power source line connected to the pixels;

generating image data by scaling grayscale values of the input image data using the scale factor;

generating a data signal corresponding to the image data; and supplying the data signal to the pixels.

14. The driving method of claim 13, wherein correcting the unit target current comprises correcting the unit target current by a reference ratio determined by referring to a plurality of RGB lookup tables that define a luminance level according to the grayscale values for each of the blocks.

15. The driving method of claim 14, wherein correcting the unit target current comprises comparing a reference lookup table defined for the reference block among the RGB lookup tables with the RGB lookup tables to calculate a luminance level ratio representing the deviation in light emitting characteristics for each of the blocks.

16. The driving method of claim 15, wherein the luminance level ratio comprises a ratio between a luminance level defined in the reference lookup table and a luminance level respectively defined in the RGB lookup tables.

17. The driving method of claim 15, wherein correcting the unit target current comprises calculating the reference ratio using the luminance level ratio calculated for each of the blocks.

18. The driving method of claim 17, wherein the reference ratio comprises an intermediate value or an average value of the luminance level ratio calculated for each of the blocks.

19. The driving method of claim 15, wherein the luminance level ratio comprises a first luminance level ratio calculated for a red grayscale value, a second luminance level ratio calculated for a green grayscale value, and a third luminance level ratio calculated for a blue grayscale value.

20. The driving method of claim 19, wherein the reference ratio comprises a first reference ratio calculated using the first luminance level ratio, a second reference ratio calculated using the second luminance level ratio, and a third reference ratio calculated using the third luminance level ratio.

* * * * *